US007325681B2

(12) United States Patent
Schönenbach

(10) Patent No.: US 7,325,681 B2
(45) Date of Patent: Feb. 5, 2008

(54) LUGGAGE WITH COMPARTMENT FOR TAKEDOWN LONG ARM

(75) Inventor: Heinrich R. Schönenbach, Remscheid (DE)

(73) Assignee: Parat-Werk Schonenbach GmbH & Co. KG, Remscheid (DE)

( * ) Notice: Subject to any disclaimer, the term of this patent is extended or adjusted under 35 U.S.C. 154(b) by 59 days.

(21) Appl. No.: 10/638,108

(22) Filed: Aug. 8, 2003

(65) Prior Publication Data

US 2004/0104136 A1 Jun. 3, 2004

(30) Foreign Application Priority Data

Aug. 15, 2002 (DE) ..... 102 38 157

(51) Int. Cl.
*B65D 85/46* (2006.01)

(52) U.S. Cl. ..... 206/317; 206/315.11; 224/912; 224/913

(58) Field of Classification Search ..... 206/317, 206/315.1, 315.11, 223; 224/912, 913; 150/109, 150/110, 111; 383/2, 6, 7; D3/262; 220/529, 220/530, 553, 554

See application file for complete search history.

(56) References Cited

U.S. PATENT DOCUMENTS

| | | | | | |
|---|---|---|---|---|---|
| 2,164,493 | A | * | 7/1939 | Branen | 190/111 |
| 2,420,347 | A | | 5/1947 | Baldwin | |
| 2,487,528 | A | * | 11/1949 | Dawson | 206/317 |
| 2,501,270 | A | * | 3/1950 | Fleming | 206/579 |
| 2,531,550 | A | | 11/1950 | Bradley | |
| 2,754,870 | A | | 7/1956 | Glantz | |
| 2,937,728 | A | * | 5/1960 | Koffler | 190/110 |
| 3,759,356 | A | * | 9/1973 | Bostick et al. | 190/111 |
| 3,811,562 | A | * | 5/1974 | Smith | 206/317 |
| 3,907,108 | A | | 9/1975 | Weimer | |
| 3,963,102 | A | * | 6/1976 | Carp | 190/108 |
| 4,212,377 | A | * | 7/1980 | Weinreb | 190/109 |
| 4,446,900 | A | * | 5/1984 | Markovich | 206/317 |
| 5,090,526 | A | * | 2/1992 | Jacober | 190/107 |
| RE34,361 | E | * | 8/1993 | Pratt | 206/579 |
| 5,484,092 | A | * | 1/1996 | Cheney | 224/404 |
| D371,942 | S | * | 7/1996 | Lippincott et al. | D7/607 |
| 5,662,219 | A | | 9/1997 | Tschudy et al. | |
| 5,669,495 | A | * | 9/1997 | West | 209/317 |
| 5,671,830 | A | * | 9/1997 | Wood | 190/101 |
| 5,881,874 | A | | 3/1999 | McKinney | |
| 6,009,996 | A | * | 1/2000 | Purdy | 206/317 |
| 6,213,268 | B1 | * | 4/2001 | Dancyger | 190/110 |
| 6,722,496 | B2 | * | 4/2004 | Gantert | 206/315.11 |

FOREIGN PATENT DOCUMENTS

| | | |
|---|---|---|
| DE | 29818077 | 2/1999 |
| DE | 200 03 209 | 5/2000 |
| EP | 0694751 | 1/1996 |

* cited by examiner

*Primary Examiner*—Shian T. Luong
(74) *Attorney, Agent, or Firm*—Andrew Wilford

(57) ABSTRACT

A piece of luggage has a closable case having an interior, a partition subdividing the interior into a gun compartment adapted to hold a gun and another compartment adapted to hold personal items. The gun is secured in place in the gun compartment. The case is elongated and has a long edge formed with an opening giving access to the other personal-item compartment and a short end formed with an opening giving access to the gun compartment. The partition extends longitudinally in the case. Alternately the case is formed by a pair of hard shells and the partition carrying the gun is pivoted between them.

16 Claims, 3 Drawing Sheets

FIG. 1
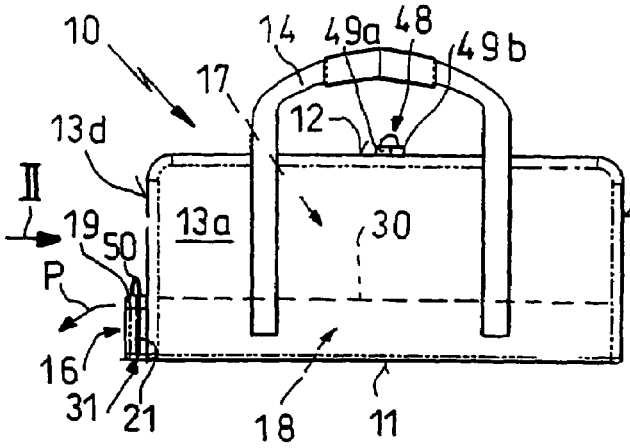
FIG. 2
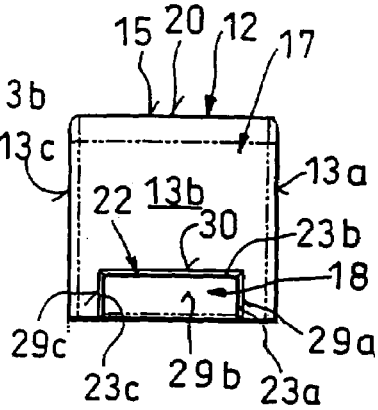
FIG. 4
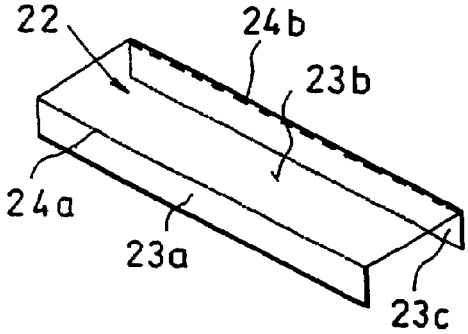
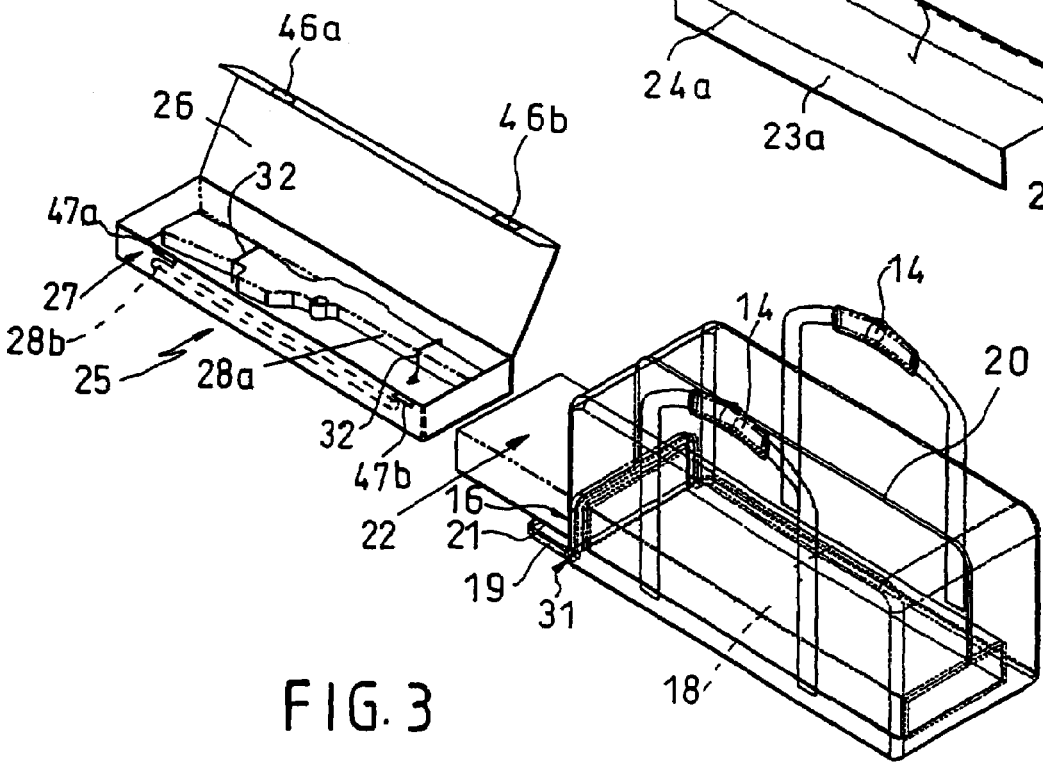
FIG. 3

LUGGAGE WITH COMPARTMENT FOR TAKEDOWN LONG ARM

FIELD OF THE INVENTION

The present invention relates to piece of luggage. More particularly this invention concerns piece of luggage adapted to carry a firearm.

BACKGROUND OF THE INVENTION

When transporting a firearm, in particular a long arm such as a rifle or shotgun, it is standard to use a gun case. When the gun is of the takedown type capable of being broken down into several short pieces, the gun case can have a size somewhat smaller than the assembled weapon; otherwise it is normally a long rectangular box of characteristic shape, although as described in U.S. Pat. No. 5,662,219 a custom case for a pistol can be fairly small. This is not a problem if one is traveling by car or train to the destination where the arm is being used, since the gun case remains in the custody of the traveler. When traveling by airplane, however, the extra gun case is a problem in that it is of a size and shape that makes it particularly easy to lose since it is much smaller than a normal piece of luggage and hard to handle because of its shape. It is also an attractive object of theft, due to the characteristic size and shape of the gun case and the fact that it can be counted on to contain something valuable.

German Utility Model 200 03 209 of Herbert Sauer describes a luggage system that is specifically set up so that a long-arm gun case can be strapped to a side of a duffel bag. This arrangement does eliminate having to handle the two pieces separately, but still leaves the gun case basically exposed and subject to theft.

OBJECTS OF THE INVENTION

It is therefore an object of the present invention to provide an improved piece of luggage.

Another object is the provision of such an improved piece of luggage which overcomes the above-given disadvantages, that is which also serves for transporting a gun.

SUMMARY OF THE INVENTION

According to the invention a piece of luggage has a closable case having an interior, a partition subdividing the interior into a gun compartment adapted to hold a gun and another compartment adapted to hold personal items. The gun is secured in place in the gun compartment. The case defines an outer contour and the compartments lie wholly within the outer contour.

Thus the instant invention eliminates the need for a separate piece of luggage for the gun, that is a big gun case. Instead the gun is carried right in a piece of luggage that looks to all effects and purposes like a standard suitcase. The traveler has one less piece of luggage to look after, and the gun is not obvious so as to attract a thief. At the same time the gun is effectively segregated from the user's personal effects so that his/her clothes will not take on a gun-oil smell.

The case according to the instant invention is elongated. It can have a long edge formed with an opening giving access to the personal-item compartment and a short end formed with an opening giving access to the gun compartment. The partition extends longitudinally in the case. This makes it particularly easy to store a long arm, in particular a takedown gun, in the luggage according to the invention. The gun compartment is only accessible through the respective opening in the short end and a cover is engageable only over the opening of the gun compartment. Thus the gun can be accessed without disturbing the user's personal effects.

Normally according to the invention the case has a rigid floor underneath the gun compartment. The case can have soft side and end walls defining the personal-item compartment above the gun compartment. The partition can also be flexible so that it can be collapsed completely when a gun is not being transported, and in fact the entire case can be collapsed to a very small volume when not in use. Normally the partition is, however, rigid. It can in fact be formed in part by a liner that is generally U-shaped and removable from the case. In this latter case a gun case holding the gun and complementarily fittable in the gun compartment can be slid into the gun compartment.

In another embodiment according to the invention the case is formed by a pair of rigid shells and a hinge securing the shells together. The partition forms the gun compartment with one of the shells and is provided between the shells. The one shell forming the gun compartment is shallower than the other shell and the other shell is provided with a carrying handle. Since the gun is typically much denser than the personal effects in the other compartment, the case is balanced.

The partition fits snugly with an edge of the one shell and is in fact hinged on the shells and pivotal between a position lying on and closing the one shell and a position lying on and closing the other shell. A latch is provided for securing the partition on the edge of the one shell so that the gun can be locked up at all times. In this arrangement the partition has a face turned toward one of the shells and provided with hook/loop tapes for securing the gun to the partition on the face.

With the system of the invention when the luggage is a large-format rectangular piece, the partition also is rectangular and the gun has a long part extending diagonally of the partition. Normally even a big takedown gun can be reduced to at most a length of about 80 cm which fits easily in the contours of a standard large suitcase, at least when on the diagonal.

BRIEF DESCRIPTION OF THE DRAWING

The above and other objects, features, and advantages will become more readily apparent from the following description, reference being made to the accompanying drawing in which:

FIG. 1 is a side view of a first piece of luggage according to the invention;

FIG. 2 is an end view of the luggage shown in FIG. 1 with some parts removed for clarity of view;

FIG. 3 is a largely schematic and exploded view of the luggage of FIG. 1;

FIG. 4 is a perspective view of a detail of the FIG. 1 luggage;

SPECIFIC DESCRIPTION

Figure 5:
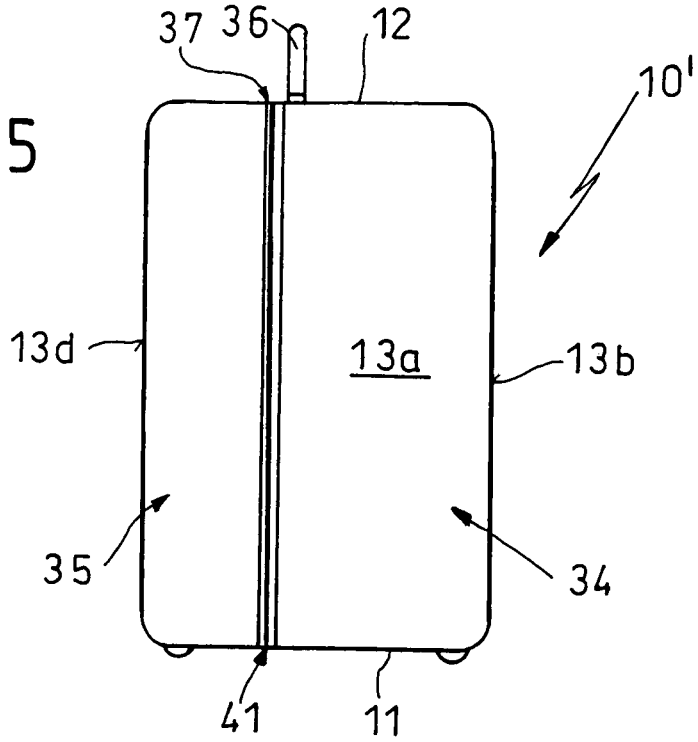
FIG. 5 is an end view of a second piece of luggage in accordance with the invention in closed condition.

As seen in FIGS. 1 through 4 a piece 10 of luggage is basically parallepipedal, having a rigid floor 11, a cover 12, two long side walls 13*a* and 13*c*, and two short end side walls 13*b*and 13*d* bridging the walls 13*a* and 13*c*. Straps 14 (not shown in FIG. 2) are attached to the side walls 13*a* and 13*c* for carrying the luggage piece 10. Whereas the floor 11 is stiff, the side walls 13*a*-13*d* are flexible, formed of canvas or the like.

The interior of the luggage piece 10 is subdivided by a partition 30 into a large upper personal-items compartment 17 accessible through an opening 15 closable by a slide fastener 20 and a catch 48 having a pair of parts 49*a* and 94*b* and a smaller lower gun compartment 18 accessible through an opening 16 covered by a flap 19 pivotal about an axis 31 as shown by arrow P and held closed by another slide fastener 21 and secured by a lock 50. The cover flap 19 is shown projecting somewhat past the end wall 13*d* although it can also be set flush therein.

The partition is in part formed by flexible panels 29*a*, 29*b*, and 29*c* forming a downwardly open U-shape so that, if the compartment 18 is empty, the panels 29*a*-29*c* can collapse, effectively reducing the volume of the compartment 18 to nothing. As shown in FIG. 4 the compartment 18 can be given a fixed shape by means of a rigid U-shaped liner element 22 having a main panel 23*b* and a pair of side panels 23*a* and 23*c* extending from outer-edge hinges 24*a* and 24*b* of the main panel 23*b*. The element 22 can be folded flat at the edges 24*a* and 24*b*, but normally is fitted inside the compartment 18 formed by the flexible panels 29*a*-29*c* to give the compartment 18 a fixed-volume parallepipedal shape.

FIG. 3 shows how a gun case 25 for a takedown long arm 28*a*, 28*b* as described in copending application (attorney's docket 22629) can be slid into the compartment 18. This case 25 has an upwardly open base 27 and a cover 26 securable in a closed position over the base 27 by catches 46*a* and 46*b* matable with keepers 47*a* and 47*b* and holds a weapon stock 28*a* and barrel 28*b* held in place by straps 32. It is dimensioned to be a snug fit in the stiffening liner plate 22 so that, when installed therein, the long arm 28*a*, 28*b* will not rattle.

Thus if, for instance, the traveler must submit the packed long arm to an inspector, for instance to verify a serial number, the case 25 can easily be withdrawn and opened for access to the weapon 28*a*, 28*b*. This can be done without having to disturb the personal items in the compartment 17.

Figure 6:
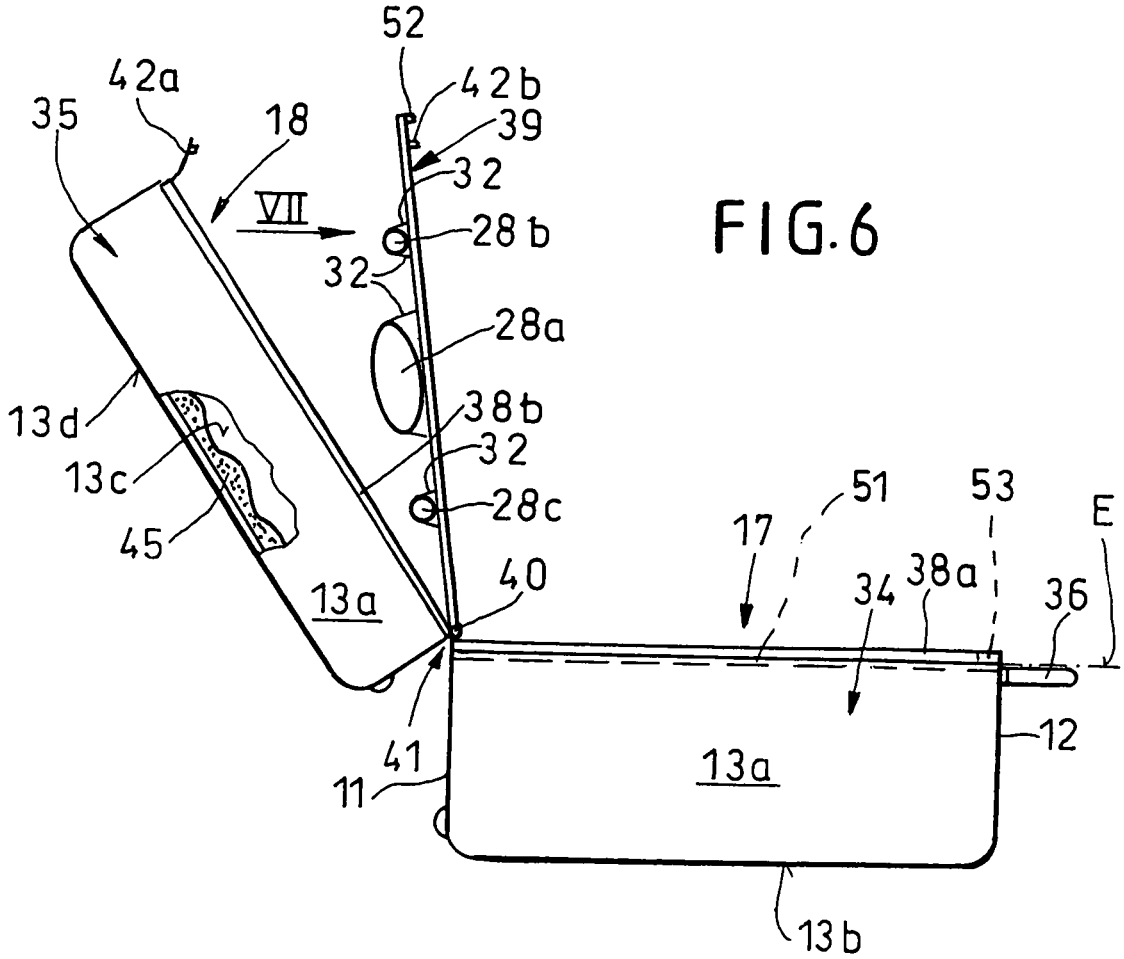
FIG. 6 is an end view of the FIG. 5 luggage in open condition and partly in section.
Figure 7:
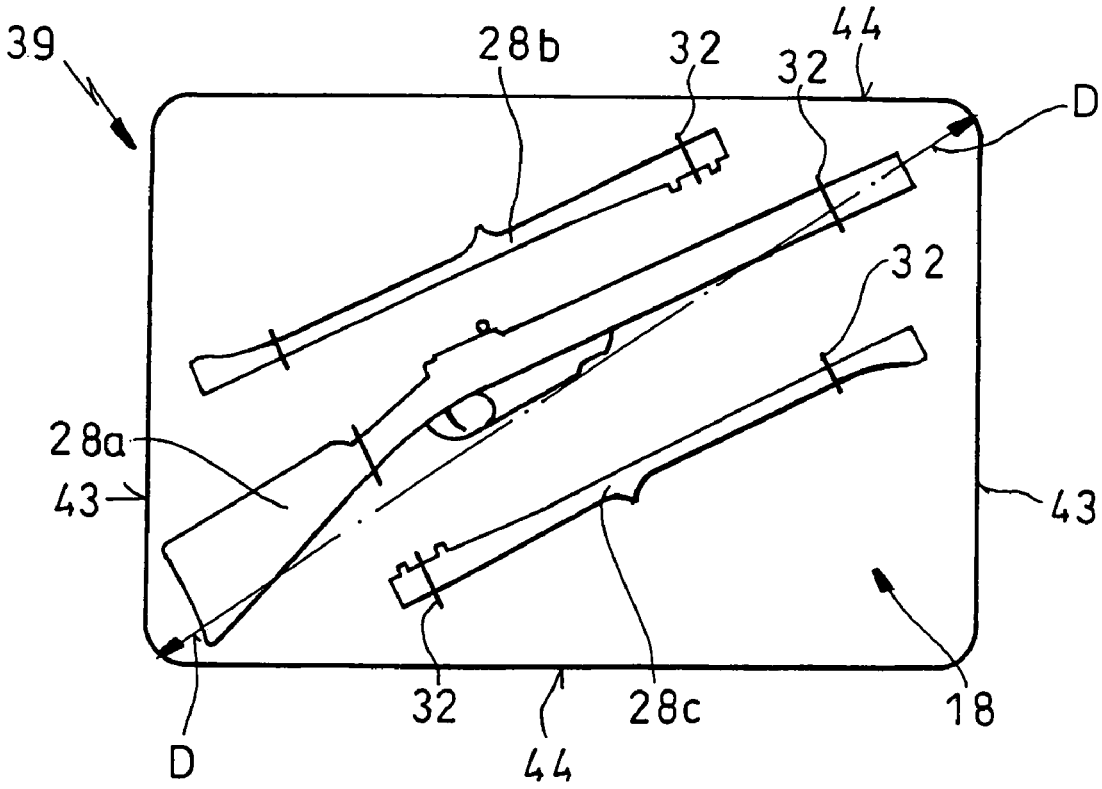
FIG. 7 is view in the direction of arrow VII of FIG. 6.

The luggage piece 10' of FIGS. 5-7 is similar to that of FIGS. 1-4 and the same reference numerals as in FIGS. 1-4 are used in FIGS. 5-7 for structurally or functionally identical parts.

The luggage piece 10' has a pair of hard shells 34 and 35, the latter somewhat shallower than the former, that together form the bottom wall 11, top wall or cover 12, and side walls 13*a*-13*d*. Here there are no straps 14; instead a handle 36 is mounted on the shell 34 slightly offset from the joint 37 between the shells 34 and 35. A hinge 41 is provided on the floor 11 between the shells 34 and 35 to allow the luggage piece 10' to be opened as shown in FIG. 6. Interfitting rails 38*a* and 38*b* along the edges of the shells 34 and 34 ensure that they fit solidly and virtually hermetically together.

Here, also pivotal about an axis 40 of the hinge 41, is an internal stiff partition board 39 made of plastic and having a smooth face turned toward the shell 34, short edges 43, long edges 44, and an array of slots (see the above-identified copending application) that allow the hook/loop straps 32 to secure the parts 28*a*, 28*b*, and 28*c* to the opposite face of the partition board 39. A soft lining 45 in the shell 35 further protects the weapon comprised of the parts 28*a*, 28*b*, and 28*c*, with the longest part, the stock 28*a*, extending along a diagonal D of the rectangular board 39 as shown in FIG. 7. Catches 42*a* on the edge of the shell 35 can mate with keepers 42*b* on the board 39 to secure it in place on the shell 35 with the gun parts 28*a*-28*c* pressed into the cushioning 45.

The partition board 39 can be pivoted out to lie on a plane E on the mouth of the shell 34, giving full access to the gun parts 28*a*-28*c*. In this position, as in the embodiment of FIGS. 1-4, easy access to the weapon is provided without having to disturb the personal effects in the shell 34. The partition 39 can be secured in place in the shell 35 also by a lock 52. The partition 39 is removably attached at the hinge 41 so that, if no gun is being transported, the luggage piece 10' can be used like a standard suitcase. It is also of course possible as indicated at dashed-line 51, to provide a cover for the mouth of the shell 34, with a lock 53 holding it in place.

In all embodiments the gun (and its case) are wholly contained within the outlines of the piece of luggage piece 10 or 10'. There is no need for a separate gun case, or the gun case 25 itself can be fitted into the compartment 18.

I claim:

1. In combination with a gun, an elongated travel bag looking like a standard luggage piece and having an interior;

a partition longitudinally subdividing the interior into an elongated gun compartment adapted to hold the gun and another compartment adapted to hold personal items, the bag having a short end formed with an opening giving access to the gun compartment;

a cover engageable only over the opening of the gun a compartment; and means for holding the gun in the gun compartment.

2. The combination defined in claim 1 wherein the travel bag has a long edge formed with an opening giving access to the other personal-item compartment bag.

3. The combination defined in claim 2 wherein the gun compartment is only accessible through the a respective opening in the short end.

4. The combination defined in claim 2 wherein the travel bag has a rigid floor underneath the gun compartment.

5. The combination defined in claim 4 wherein the travel bag has soft side and end walls defining the personal-item compartment above the gun compartment.

6. The combination defined in claim 1 wherein the partition is generally U-shaped.

7. The combination defined in claim 1 wherein the holding means is a rigid gun case holding the gun and complementarily fittable in the gun compartment.

8. The combination defined in claim 1 wherein the travel bag defines an outer contour and the compartments lie wholly within the outer contour.

9. In combination with a gun, an elongated travel bag looking like a standard luggage piece and having an interior;

a partition transversely subdividing the interior into an elongated gun compartment of rectangular section adapted to hold the gun and another elongated compartment adapted to hold personal items, the bag having a short end formed with an opening giving access to the gun compartments;

a cover engageable only over the opening of the gun compartment; and means for holding the gun in the gun compartment.

10. In combination with a gun, a travel bag looking like a standard luggage piece and having an interior;

a partition transversely subdividing the interior into a lower elongated gun compartment of rectangular section adapted to hold the gun and an upper compartment adapted to hold personal items, the bag having a short end formed with an opening giving access to the gun compartment;

a cover engageable only over the opening of the gun compartment; and means for holding the gun in the gun compartment.

11. In combination with a gun, a travel bag looking like a standard luggage piece and having an interior;

a partition transversely subdividing the interior into a lower elongated gun compartment of rectangular section adapted to hold the gun and having a short longitudinal end formed with an opening giving access to the gun compartment and an upper elongated compartment adapted to hold personal items;

a cover engageable only over the opening of the gun compartment; and means for holding the gun in the gun compartment.

12. In combination with a gun, a travel bag looking like a standard luggage piece and having an interior;

a partition transversely subdividing the interior into an elongated gun compartment of rectangular section adapted to hold the gun and an upper elongated compartment adapted to hold personal items, the gun compartment having transversely relatively wide horizontal top and bottom walls and vertically relatively narrow upright side walls, the bag having a short end formed with an opening giving access to the gun compartment;

a cover engageable only over the opening of the gun compartment; and means for holding the gun in the gun compartment.

13. The travel bag defined in claim 12 further comprising handles attached to upright side faces of the bag and oriented for carrying the travel bag with the top and bottom walls of the gun compartment horizontal.

14. In combination with a gun, a travel bag looking like a standard luggage piece and having an interior;

a partition transversely subdividing the interior into an elongated gun compartment adapted to hold the gun and another elongated compartment adapted to hold personal items, the bag having flexible side walls at the other compartment, the partition having rigid side walls at the gun compartment, the bag having a short end formed with an opening giving access to the gun compartment;

a cover engageable only over the opening of the gun compartment; and means for holding the gun in the gun compartment.

15. In combination with a gun, a travel bag looking like a standard luggage piece and having an interior;

a downwardly U-shaped partition transversely subdividing the interior into an elongated gun compartment adapted to hold the gun and another elongated compartment adapted to hold personal items, the other compartment extending laterally downward past both sides of and at least partially laterally surrounding the gun compartment; and means for holding the gun in the gun compartment.

16. The travel bag defined in claim 15 wherein a common rigid planar panel forms a floor of the gun compartment and of side regions of the other compartment.

* * * * *